US007230178B2

(12) United States Patent
Ishida et al.

(10) Patent No.: US 7,230,178 B2
(45) Date of Patent: Jun. 12, 2007

(54) HANDY MUSICAL INSTRUMENT RESPONSIVE TO GRIP ACTION

(75) Inventors: Kenji Ishida, Hamamatsu (JP); Yoshiki Nishitani, Hamakita (JP)

(73) Assignee: Yamaha Corporation, Shizuoka-Ken (JP)

( * ) Notice: Subject to any disclaimer, the term of this patent is extended or adjusted under 35 U.S.C. 154(b) by 208 days.

(21) Appl. No.: 10/458,890

(22) Filed: Jun. 11, 2003

(65) Prior Publication Data

US 2003/0230186 A1 Dec. 18, 2003

(30) Foreign Application Priority Data

Jun. 13, 2002 (JP) ..... 2002-173276

(51) Int. Cl.
*G10H 4/00* (2006.01)

(52) U.S. Cl. ..... 84/615; 84/658; 84/687

(58) Field of Classification Search ..... 84/615–620, 84/653–658, 678–690
See application file for complete search history.

(56) References Cited

U.S. PATENT DOCUMENTS 4,282,681 A * 8/1981 McCaslin ..... 446/484
4,341,140 A * 7/1982 Ishida ..... 84/711
5,170,002 A * 12/1992 Suzuki et al. ..... 84/600
5,177,311 A 1/1993 Suzuki et al.
5,192,823 A * 3/1993 Suzuki et al. ..... 84/600
5,422,956 A * 6/1995 Wheaton ..... 381/122
5,585,584 A * 12/1996 Usa ..... 84/600
5,816,885 A * 10/1998 Goldman et al. ..... 446/397
6,626,728 B2 * 9/2003 Holt ..... 446/219
2001/0039871 A1 11/2001 Ono et al.

FOREIGN PATENT DOCUMENTS

JP 2001-184072 7/2001

* cited by examiner

*Primary Examiner*—Lincoln Donovan
*Assistant Examiner*—David S. Warren
(74) *Attorney, Agent, or Firm*—Harness, Dickey & Pierce, PLC

(57) ABSTRACT

In a music system, an input unit is manipulated for inputting a signal representative of a performance operation amount rendered by a performer, and an output unit is provided for outputting a music sound in response to the signal fed from the input unit. The input unit has a grip part that is grasped by the performer and shaped to receive a dynamic pressure caused from grasping by the performer for inputting the performance operation amount. A conversion part is provided in the input unit for converting the dynamic pressure applied by the performer into a force acting in a specified direction. A detection part is positioned to align a sensitivity thereof with the specified direction for sensing the force generated by the conversion part and outputting the signal indicative of the performance operation amount in response to the sensed force.

12 Claims, 13 Drawing Sheets

HANDY MUSICAL INSTRUMENT RESPONSIVE TO GRIP ACTION

BACKGROUND OF THE INVENTION

1. Technical Field of the Invention

The present invention relates to a performance operation amount detection apparatus which detects a performance operation input by a performer.

2. Prior Art

Conventionally, there is known a performance apparatus that is provided with a motion sensor such as an acceleration sensor in a performance operation tool shaped like a baton, and generates musical sounds or changes the tempo of a song being reproduced according to a detection result of the motion sensor. Using such a performance apparatus, a user (performer) is capable of enjoying performance just by manually holding and shaking the performance operation tool without having high performance technique.

Further, there is proposed another form of the performance operation device for inputting performance operations. This type of performance operation device is attached to a user's hand so that user's fingers closely contact with pressure sensors. The performance operation device detects a finger bend state as a performance operation.

However, these performance operation devices cause the following problems. In order to shake the performance operation tool of the baton shape having the motion sensor, muscular movements are needed not only for gripping the performance operation tool, but also for moving an upper arm and a shoulder. For this reason, the performance operation becomes a physical burden to users of weak muscle such as aged persons, thereby making a long performance difficult.

In case of the performance operation device designed to detect finger bend states, the pressure sensor directly contacts the user skin, giving uncomfortable feeling to users. The detection of finger bend states requires a sensor to detect forces acting from a plurality of directions. This increases production costs of the performance operation device. In addition, it has been troublesome to attach or detach the performance operation device for starting or stopping performance operations. Further, the performance operation device may be accidentally displaced from an attached position during performance.

SUMMARY OF THE INVENTION

The present invention has been made in consideration of the foregoing. It is therefore an object of the present invention to provide a performance operation amount detection apparatus capable of easily conducting performance operations at low costs.

In order to achieve the above-mentioned object, an inventive apparatus is designed for detecting a performance operation amount rendered by a performer. The inventive apparatus comprises a grip part that is grasped by the performer and shaped to receive a dynamic pressure caused from grasping by the performer for inputting the performance operation amount, a conversion part that is provided for converting the dynamic pressure applied by the performer into a force acting in a specified direction, and a detection part that is positioned to align a sensitivity thereof with the specified direction for sensing the force generated by the conversion part and outputting a signal indicative of the performance operation amount in response to the sensed force.

Preferably, the grip part, the conversion part and the detection part are assembled into a set, and the apparatus further comprises a body that is shaped so as to mount therein a plurality of the sets. In a practical form, the body is shaped into a rod so that a pair of the sets is mounted in a pair of end portions of the rod. Otherwise, the body is shaped into a cross so that a quartet of the sets is mounted in four end portions of the cross.

Preferably, the inventive apparatus further comprises a sealing part for sealing the detection part. Further, the inventive apparatus comprises a restoring part operative when the grip part is released from grasping of the performer for creating a restoration force effective to restore the conversion part into a rest state thereof. Moreover, the inventive apparatus comprises a wireless transmitting part that transmits the signal in a wireless mode.

In a specific form, the grip part has a sleeve shape grasped by the performer to receive the dynamic pressure in radially inward directions of the sleeve shape, and the conversion part has a rod shape, an end portion of which is fitted into the sleeve shape of the grip part. The end portion of the rod shape is cut into a pair of split sections spaced from each other in the specified direction, the split sections being deformable for converting the dynamic pressure applied in the radially inward directions from the grip part into the force acting in the specified direction.

In another specific form, the grip part comprises a tube filed with a fluid and grasped by the performer to receive the dynamic pressure, and the conversion part comprises a piston movable in the specified direction for converting the dynamic pressure transmitted to the piston through the fluid into the force acting in the specified direction.

In a further aspect of the invention, a music system comprises an input unit for inputting a signal representative of a performance operation amount rendered by a performer, and an output unit for outputting a music sound in response to the signal fed from the input unit. The input unit comprises a grip part that is grasped by the performer and shaped to receive a dynamic pressure caused from grasping by the performer for inputting the performance operation amount, a conversion part that is provided for converting the dynamic pressure applied by the performer into a force acting in a specified direction, and a detection part that is positioned to align a sensitivity thereof with the specified direction for sensing the force generated by the conversion part and outputting the signal indicative of the performance operation amount in response to the sensed force.

Preferably, the input unit includes a wireless transmitter part for transmitting the signal in a wireless mode, and the output unit includes a wireless receiver part for receiving the signal in a wireless mode.

Practically, the output unit comprises a generator for generating the music sound composed of a plurality of music parts, and a controller for allotting at least one music part to the input unit while controlling the generator to automatically generate the music sound of the remaining music parts other than the one music part allotted to the input unit such that the performer can manually perform the one music part by operating the input unit along with automatic performance of the remaining music parts by the controller.

According to this configuration, the performer (user) can conduct a music performance operation by holding the grip part and changing a grip strength applied to the grip part. Consequently, action for instructing the music performance operation requires no movement for an upper arm, a shoulder, and the like, thereby decreasing the performer's physical burden.

The conversion part extracts and converts the dynamic pressure applied to the grip part into a force acting along the specified direction. It is possible to use a simple sensor detecting only unidirectional force as the detection part. Accordingly, a low-price sensor can be used for the detection part. As a result, it becomes possible to suppress manufacturing costs of the performance operation amount detection apparatus.

DETAILED DESCRIPTION OF THE INVENTION

Embodiments of the present invention will be described in further detail with reference to the accompanying drawings.

<First Embodiment>

Figure 1:
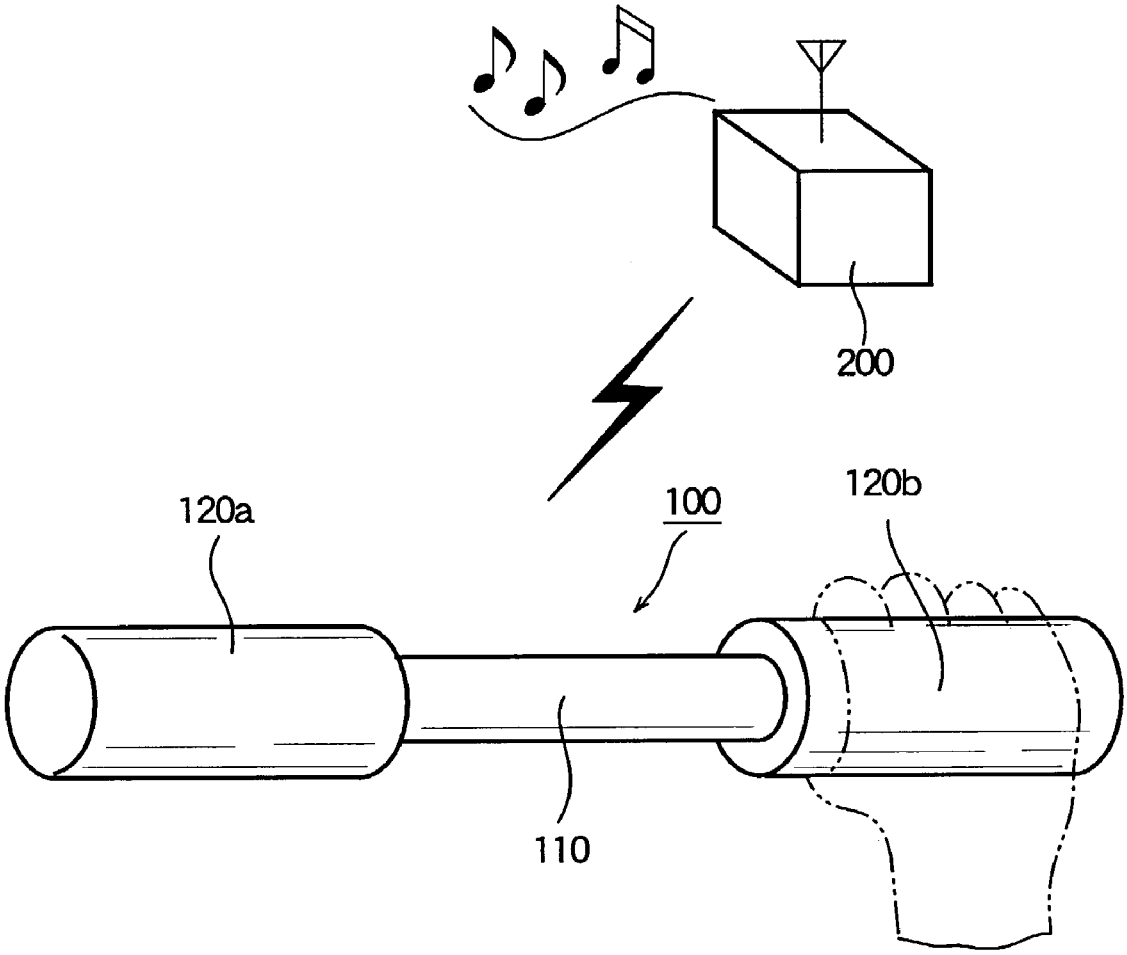
FIG. 1 shows a configuration of a music performance system according to the first embodiment of the present invention.

FIG. 1 shows a configuration of a music performance system including an operation apparatus according to the first embodiment of the present invention. In FIG. 1, an operation apparatus 100 is approximately shaped like a stick or rod and comprises a shaft 110 and two grips 120*a* and 120*b* provided at both ends thereof. The grips 120*a* and 120*b* are so formed that a user (performer) can hold either of them by one hand. The grips 120*a* and 120*b* function as performance operation devices in the performance system. The operation apparatus 100 is provided with a sensor that detects the magnitude of a grip strength applied to the grips 120*a* and 120*b* when they are held. The sensor transmits a detection result as a radio signal indicating a degree of the performance operation.

A sound reproduction apparatus 200 includes a speaker and the like, receives a radio signal transmitted from the operation apparatus 100, and generates music sound according to the signal via the speaker.

Figure 2:
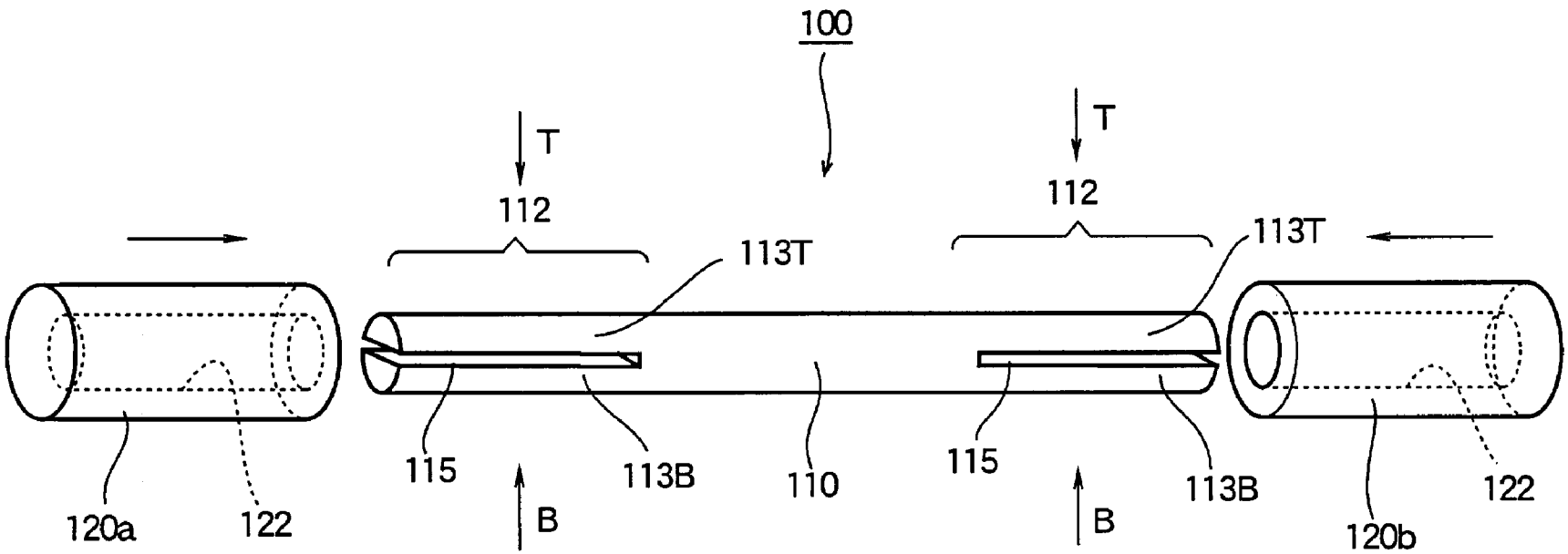
FIG. 2 is a exploded perspective view of an operation apparatus included in the performance system according to the first embodiment of the present invention.

FIG. 2 is an exploded perspective view of the operation apparatus 100. As shown in FIG. 2, the operation apparatus 100 is configured symmetrically with respect to both ends. Accordingly, the following description will be focused on only the grip 120*a* unless otherwise specified. The grip 120*a* is made of a cushioning material such as urethane foam. At one end of the grip 120*a* along the longer direction, there is formed a hole 122 capable of inserting an end section 112 of the shaft 110. When the operation apparatus 100 is assembled, the end section 112 of the shaft 110 is inserted into the hole 122 of the grip 120*a*.

A flat groove 115 is formed in the end section 112 of the shaft 110 along its axis line. The end section 112 has a divided or split structure comprising an elastically deforming section 113T, i.e., an upper part in the figure, and an elastically deforming section 113B, i.e., a lower part in the figure. The shaft 110 is made of a highly elastic material such as wood. When a force is applied to the elastically deforming section 113T in the direction of T of the figure, the elastically deforming section 113T deforms in the direction of T. When another force is applied to the elastically deforming section 113B in the direction of B of the figure, the elastically deforming section 113B deforms in the direction of B. When the force is applied in the direction of T or B, each of the elastically deforming sections 113T and 113B deforms so that they get closer to each other. Here, the direction T or B is approximately perpendicular to the plane surface of the groove 115 and is opposite to each other.

Figure 3:
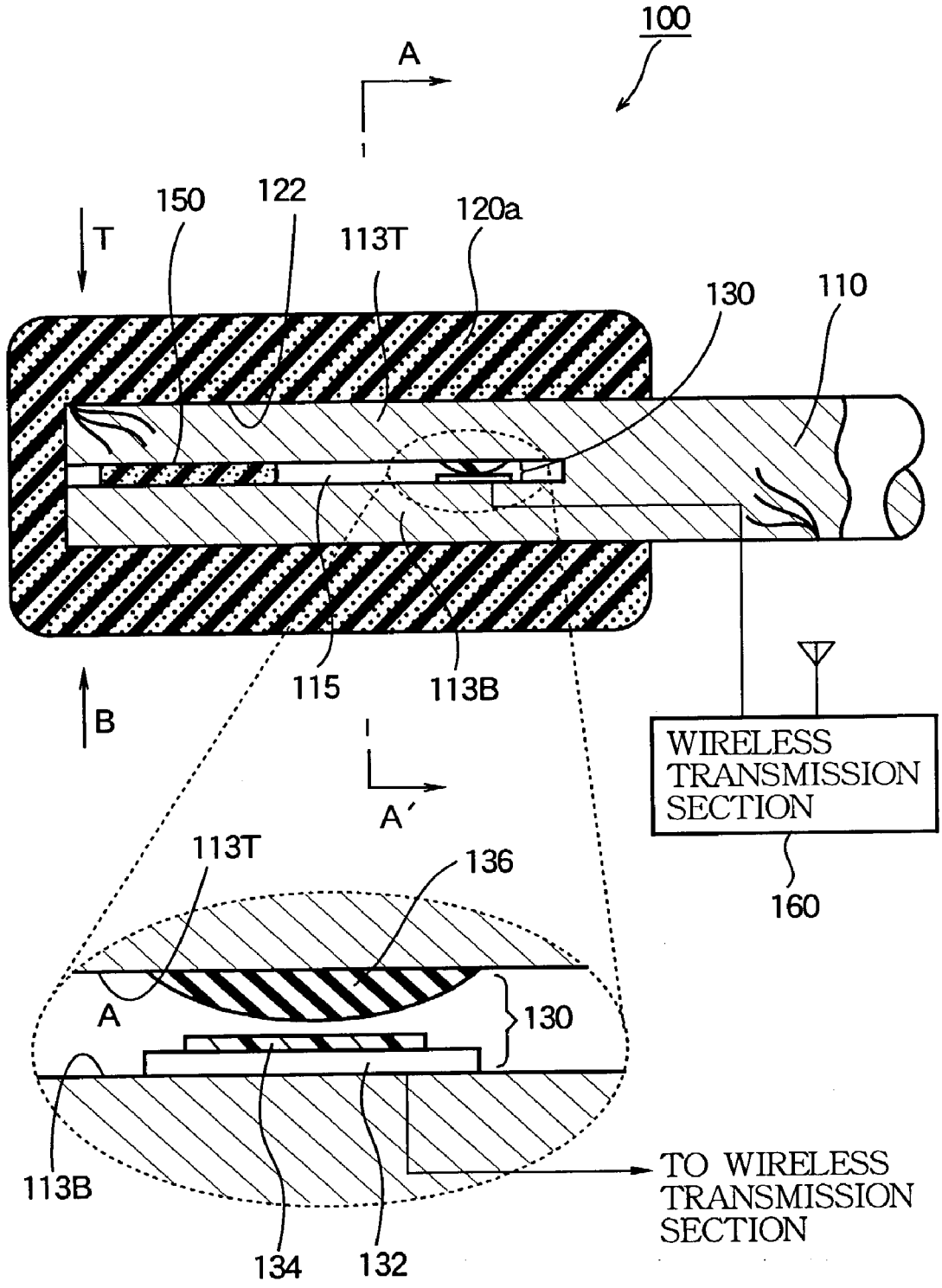
FIG. 3 is a sectional view of a grip and its peripheral configuration of the operation apparatus according to the first embodiment of the present invention.

FIG. 3 is a cross sectional view of the grip 120*a* and its surrounding configuration. When the operation apparatus 100 is assembled as shown in FIG. 3, the elastically deforming sections 113T and 113B are enclosed in the hole 122 of the grip 120*a*. The operation apparatus 100 comprising the shaft 110 and the grip 120*a* is covered with an airtight sealing. Accordingly, the groove 115 formed in the shaft 110 has airtightness.

Figure 4:
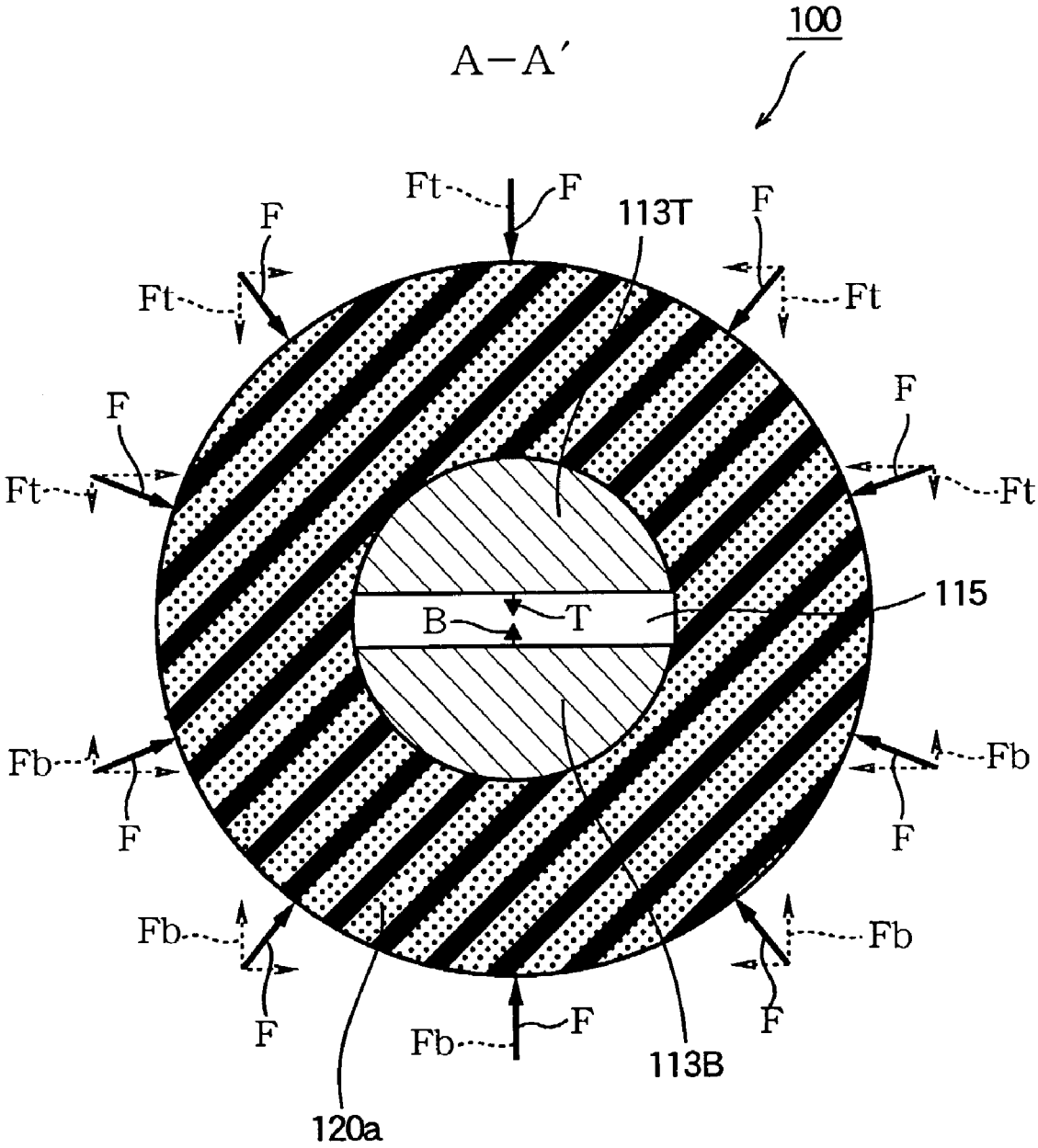
FIG. 4 is a sectional view of the operation apparatus according to the first embodiment of the present invention.

When a user holds the grip 120*a*, a grip strength acts on the elastically deforming sections 113T and 113B via the grip 120*a*. FIG. 4 is a cross sectional view of the operation apparatus 100 taken along lines A–A' in FIG. 3. As shown in FIG. 4, when the user grasps the grip 120*a*, it is subject to a plurality of dynamic pressure forces F (indicated by arrows in FIG. 4) in directions different from each other. These forces F are transmitted to each of the elastically deforming sections 113T and 113B via the grip 120*a*. The elastically deforming section 113T deforms in the T direction in response to only the component Ft in the T direction included in the forces F acting in various directions. On the other hand, the elastically deforming section 113B deforms in the B direction in response to only the component Fb in the B direction included in the forces acting in various directions. In other words, the elastically deforming section 113T extracts the component Ft in the T direction from a plurality of forces F acting on the grip 120*a* and deforms accordingly. The elastically deforming section 113B extracts the component Fb in the B direction from a plurality of forces F acting on the grip 120*a* and deforms accordingly.

According to this configuration, when the user holds the grip 120*a*, the elastically deforming sections 113T and 113B convert the holding forces into a pressure force constituent along a definite direction.

Again in FIG. 3, the groove or recess contains a sensor mechanism 130 for detecting a grip strength. In more detail, as shown in an enlarged view of FIG. 3, a pressure sensor 132 is provided on the top surface of the elastically deforming section 113B to detect a pressure force applied from one direction. The pressure sensor 132 is available from various types of sensors such as a piezoelectric element to detect pressures, a strain gage to detect a strain corresponding to the pressure, and the like. For convenience of description, the following describes an example of using a piezoelectric element for the pressure sensor 132. The pressure sensor 132 is provided to detect the T direction. When a force is applied in the T direction, the pressure sensor 132 generates a voltage corresponding to the pressure. On the pressure sensor 132, there is provided a sensor cover 134 for protecting the pressure sensor 132. A pressurization member 136, made of a medium elastic material such as rubber, is provided on the bottom surface of the elastically deforming section 113T at a position opposite to the pressure sensor 132. According to this configuration, the sensor mechanism 130 is applied with a grip force which deforms the elastically deforming sections 113T and 113B so that they approach to each other. Then, the pressurization member 136 presses the pressure sensor 132 via the sensor cover 134. In response to this, the pressure sensor 132 generates a voltage corresponding to the pressure, i.e., corresponding to the grip strength applied to the grip 120*a*.

Figure 5:
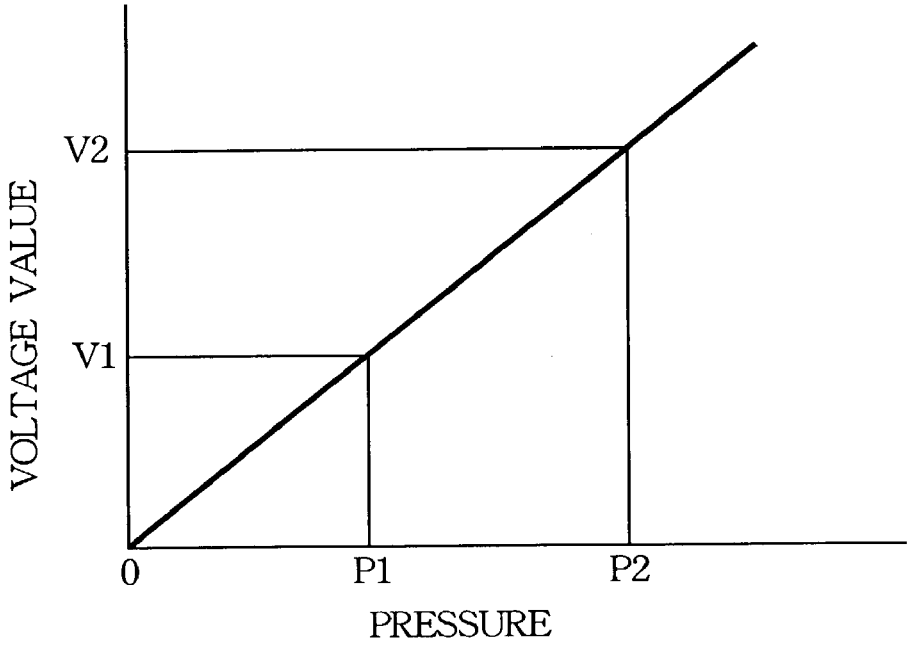
FIG. 5 shows characteristics of a pressure sensor provided in the operation apparatus according to the first embodiment of the present invention.

FIG. 5 shows characteristics of the pressure sensor 132. In FIG. 5, the abscissa indicates a pressure acting on the pressure sensor 132. The ordinate indicates a voltage generated from the pressure sensor 132. FIG. 5 shows that, as a pressure acting on the pressure sensor 132 increases, the pressure sensor 132 generates increasing detection values. For example, let us assume to detect pressures P1 and P2 (P1<P2) at two points on the abscissa in FIG. 5. Then, if the pressurization member 136 applies pressure P1, the pressure sensor 132 detects voltage V1. If the pressurization member 136 applies pressure P2, the pressure sensor 132 detects voltage V2 (V2>V1). As will be discussed in more detail below, the pressure sensor 132 is subject to pressure P1 if the grip 120*a* is grasped gently. The pressure sensor 132 is subject to pressure P2 if the grip 120*a* is grasped strongly.

Now let us return to the description in FIG. 3. The pressure sensor 132 is connected to a wireless transmission section 160 and applies a voltage corresponding to the grip strength to the wireless transmission section 160. When the pressure sensor 132 applies a voltage, the wireless transmission section 160 transmits a detected voltage value V. In addition to the detected voltage value V, the wireless transmission section 160 transmits information indicating one of the grips 120*a* and 120*b* which corresponds to the voltage value V.

Part of the groove 115 is filled with an elastic member 150 made of a cushioning material such as urethane foam. When the grip strength is released, the elastic member 150 supplies a restoring force to each of the elastically deforming sections 113T and 113B. In more detail, a grip strength acts on the grip 120*a* to deform the elastically deforming sections 113T and 113B so that they approach to each other. Then, the elastic member 150 is compressed and deformed vertically in FIG. 3 to accumulate an elastic energy. When the grip strength is released, the elastic member 150 releases the elastic energy to restore each of the elastically deforming sections 113T and 113B to the original rest state. That is to say, the elastic member 150 applies a force in the B direction to the elastically deforming section 113T and a force in the T direction to the elastically deforming section 113B. It should be noted that the elastic member 150 can be omitted if each of the elastically deforming sections 113T and 113B has a sufficient restoring capability when the grip strength is released.

As described above, the inventive operation apparatus is designed for detecting a performance operation amount rendered by a performer. In the apparatus 100 of the handy type, the grip part 120*a* is grasped by the performer and shaped to receive a dynamic pressure caused from grasping by the performer for inputting the performance operation amount. The conversion part is provided for converting the dynamic pressure applied by the performer into a force acting in a specified direction T-B. The detection part 130 is positioned to align a sensitivity thereof with the specified direction T-B for sensing the force generated by the conversion part and outputting a signal indicative of the performance operation amount in response to the sensed force. Specifically, the grip part 120*a* has a sleeve shape grasped by the performer to receive the dynamic pressure in radially inward directions of the sleeve shape. The conversion part has a rod shape 110, an end portion of which is fitted into the sleeve shape of the grip part 120*a*. The end portion of the rod shape 110 is cut into a pair of split sections 113T and 113B spaced from each other in the specified direction. The split sections 113T and 113B are deformable for converting the dynamic pressure applied in the radially inward directions from the grip part 120*a* into the force acting in the specified direction.

In addition to the above-mentioned configuration, the handy operation apparatus 100 of the grip action type is provided with a power supply to provide power supply voltage to the wireless transmission section 160, a switch for a user to start transmitting a performance operation signal, and the like. However, these components are not directly relevant to the present invention, and therefore the description thereof is omitted.

Figure 6:
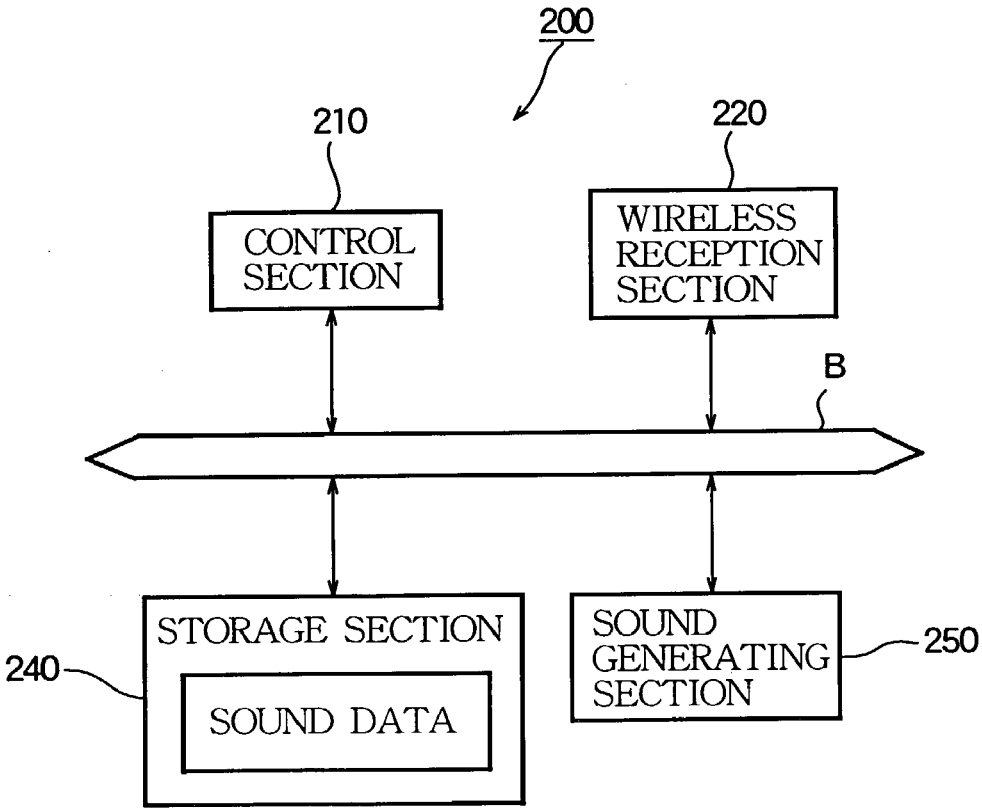
FIG. 6 shows an electrical configuration of a sound reproduction apparatus included in the performance system according to the first embodiment of the present invention.
Figure 7:
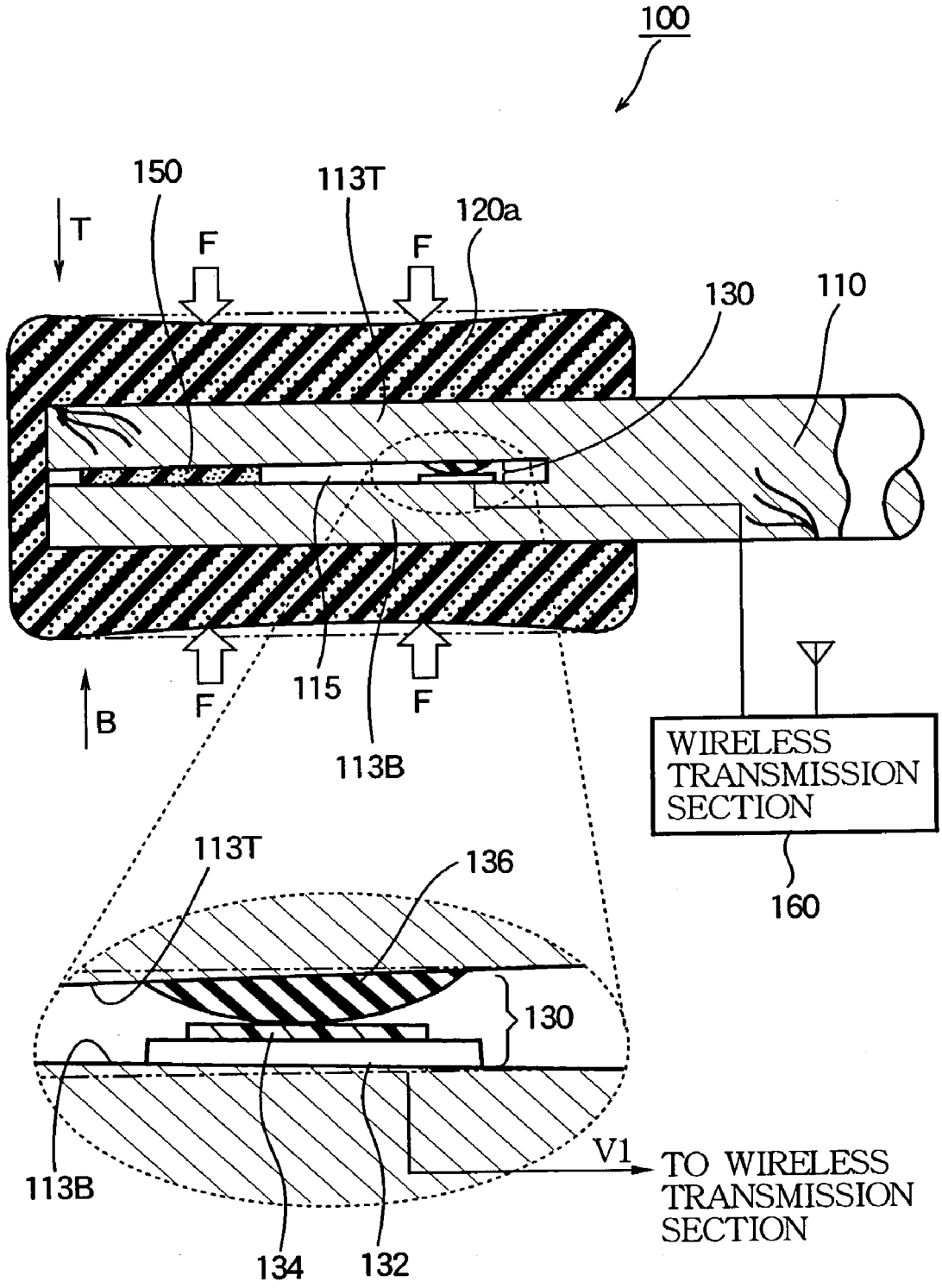
FIG. 7 shows a state of gently grasping the grip according to the first embodiment of the present invention.

FIG. 6 shows an electrical configuration of the sound reproduction apparatus 200. In this figure, a control section 210 controls each component via a bus B. A storage section 240 stores sound data. The sound data represents musical sounds such as a MIDI (Musical Instruments Digital Interface) sound. The sound data can be used to generate various musical sounds similar to a triangle, a whistle, cymbals, and the like.

A wireless reception section 220 receives a voltage value V transmitted from the operation apparatus 100 and supplies the voltage value V to the control section 210. When receiving the voltage value V, the control section 210 provides control so as to reproduce a musical sound signal with a sound volume corresponding to the voltage value V. When the received voltage value V represents V1 and indicates a situation where the grip 120*a* is grasped, for example, the control section 210 outputs, e.g., the triangle sound at sound volume level VOL1 corresponding to a pressure applied to the grip 120*a*. When the voltage value V indicates a situation where the grip 120*b* is grasped, the control section 210 outputs, e.g., the whistle sound at a sound volume level VOL1 corresponding to a pressure applied to the grip 120*b*. When the received voltage value V represents V2 and indicates a situation where the grip 120*a* is grasped, the control section 210 outputs the triangle sound at sound volume level VOL2 corresponding to a pressure applied to the grip 120*a*. When the voltage value V indicates a situation where the grip 120*b* is grasped, the control section 210 outputs the whistle sound at a sound volume level VOL2 corresponding to a pressure applied to the grip 120*b*.

The following describes the operation of the performance system. In this operation, the operation apparatus 100 detects a grip strength acting on the grip 120*a* and allows the sound reproduction apparatus 200 to output a musical sound with the sound volume level corresponding to a detection result. Operations for the grip 120*b* are same as those for the grip 120*a* except that different types of musical sounds are output. Therefore, the description of the operations for the grip 120*b* is omitted.

If the grip 120*a* is not grasped, the pressurization member 136 and the sensor cover 134 are separated from each other as shown in FIG. 3. No pressure is applied to the pressure sensor 132. The pressure sensor 132 feeds no voltage to the wireless transmission section 160. The wireless transmission section 160 transmits no voltage value V. The sound reproduction apparatus 200 performs no processing.

When the grip 120*a* is grasped gently, the elastically deforming sections 113T and 113B deform so as to approach to each other. The pressurization member 136 presses the pressure sensor 132 with a pressure force of approximately P1 via the sensor cover 134. Then, the pressure sensor 132 applies voltage value V1 to the wireless transmission section 160 which then transmits voltage value V1.

In the sound reproduction apparatus 200, the wireless reception section 220 receives the voltage value V1 and supplies this voltage value to the control section 210. When receiving voltage value V1, the control section 210 outputs the triangle sound at sound volume level VOL1 from a sound generating section 250 using sound data stored in the storage section 240.

Figure 8:
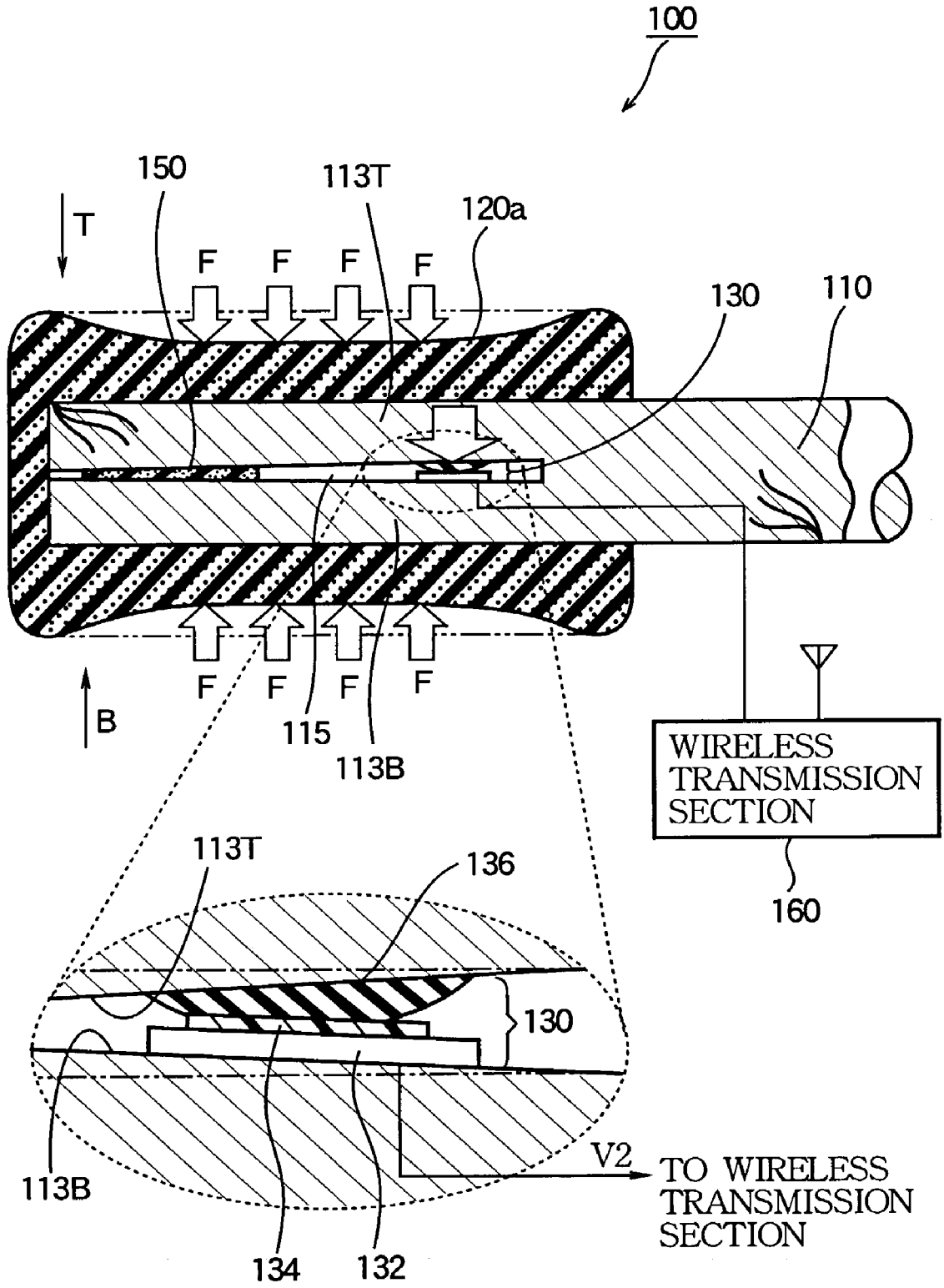
FIG. 8 shows a state of strongly grasping the grip according to the first embodiment of the present invention.

When the grip 120*a* is grasped strongly as shown in FIG. 8, the elastically deforming sections 113T and 113B each deforms so as to approach to each other more closely than the grip 120*a* is grasped gently. The pressurization member 136 presses the pressure sensor 132 with pressure force of approximately P2 via the sensor cover 134. Then, the pressure sensor 132 applies voltage value V2 to the wireless transmission section 160 which then transmits the voltage value V2.

In the sound reproduction apparatus 200, the wireless reception section 220 receives voltage value V2 and supplies this voltage value to the control section 210. When receiving voltage value V2, the control section 210 outputs the triangle sound at sound volume level VOL2 from the sound generating section 250 using sound data stored in the storage section 240.

As described above, the music performance system is comprised of the handy input unit 100 of the grip action type for inputting a signal representative of a performance operation amount rendered by a performer, and the output unit 200 for outputting a music sound in response to the signal fed from the input unit 100. The output unit 200 has the generator 250 for generating the music sound composed of a plurality of music parts, and the controller 210 for allotting at least one music part such as a triangle part to the input unit 100 while controlling the generator 250 to automatically generate the music sound of the remaining music parts other than the one music part allotted to the input unit 100 such that the performer can manually perform the one music part by operating the input unit 100 along with automatic performance of the remaining music parts by the controller 210.

Using the operation apparatus 100 included in the performance system, the user can input performance operations just by changing a force for grasping the grips 120*a* and 120*b*. Accordingly, there is provided the operation apparatus 100 enabling performance operations more easily for everyone compared to the performance operation device having the conventional acceleration sensor.

In more detail, a user needs to shake the conventional performance operation device having the acceleration sensor and the like for inputting performance operations. For this reason, the performance operation becomes a physical burden to users such as aged persons and infants having weak muscles at upper arms or shoulders, making a long performance difficult. On the contrary, the operation apparatus 100 can input performance operations by changing grip strengths. Generally, it is said that the infant muscle used for grip strengths more develops than the other muscles. It is also said that the decline of aged people's grip strengths due to aging is slower than the other physical functions. In addition, the muscle fatigue due to grip strengths decreases if the strength intensity is not excessive. For these reasons, performance operations using the operation apparatus 100 give small physical loads to users of a wide age group from infants to aged people. As a result, these users can enjoy the performance for a long time. Since the performance system has this advantage, the following application examples are available.

Figure 9:
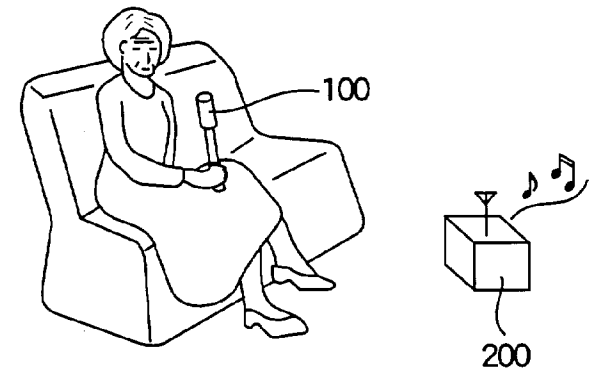
FIGS. 9(*a*) through 9(*d*) show examples of using the performance system according to the first embodiment of the present invention.
Figure 9:
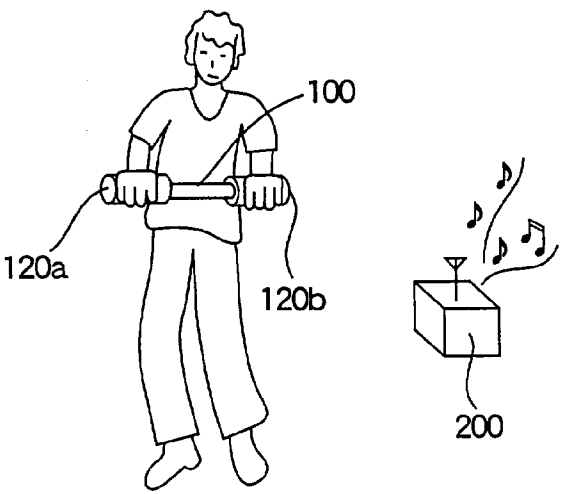
Figure 9:
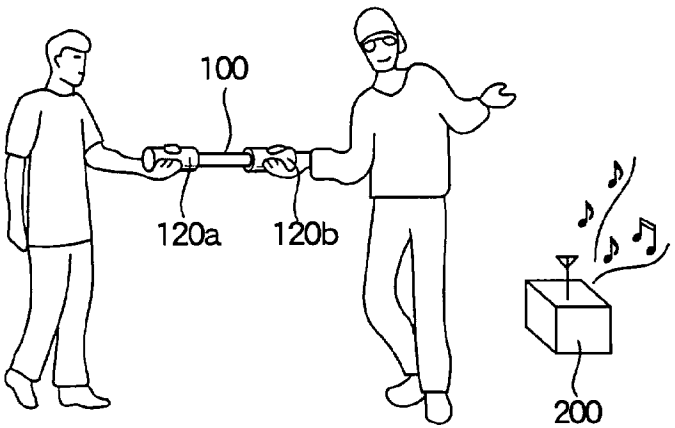
Figure 9:
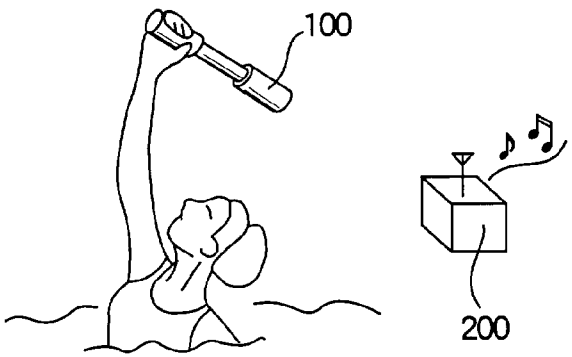

For example, only a grip strength enables performance operations. As shown in FIG. 9(*a*), an aged person, even sitting on a chair, can enjoy the performance. Since performance operations serve as training for the brain such as reflexes, the performance system can be used to prevent the intellectual decline due to aging.

Even a physically handicapped person can enjoy the performance if muscles for grip strengths function. Therefore, the performance system can be used for the music therapy and the like. Further, the performance system may be used to rehabilitate hands or fingers. In addition to possible rehabilitation effects expected, a patient can undergo rehabilitation by enjoying the performance. Consequently, it is possible to decrease a mental burden for the rehabilitation.

Further, the operation apparatus 100 includes two grips 120*a* and 120*b* as performance operation devices. Accordingly, a user can input performance operations with both hands as shown in FIG. 9(*b*). At this time, the user can input performance operations to each of the grips 120*a* and 120*b* independently. In addition, it is possible to concurrently input different performance operations, e.g., by operating output of the triangle sound with the right hand and output of the whistle sound with the left hand.

Since there are provided two grips 120*a* and 120*b*, each of two users can input performance operations by operating one of the grips 120*a* and 120*b* as shown in FIG. 9(*c*) to be able to share one operation apparatus 100 with two users. The users can be conscious about participation in an ensemble performance, promoting the feeling of intimacy and the sense of togetherness among users. The performance system can be used as communication means.

Moreover, the operation apparatus 100 uses the airtight groove 115 to store the sensor mechanism 130. As shown in FIG. 9(*d*), the operation apparatus 100 can be also used in water such as a swimming pool. A user is capable of synchronized swimming or water exercise by playing the accompaniment.

Though not limited in the water, a user can do exercise by playing the accompaniment according to a degree of his or her fatigue. As a result, the user can give the performance at his or her own pace and do exercise enjoyably, easily to the performance. In addition, since the operation apparatus 100 just requires a grip strength for performance, action for the performance does not restrict arm motions or the like used for the exercise.

Furthermore, the operation apparatus 100 can prevent an excess load on the pressure sensor 132 by appropriately adjusting a shape or a material for the elastically deforming sections 113T and 113B. This prolongs the life of the sensor mechanism 130 and consequently improves the durability of the operation apparatus 100.

According to the operation apparatus 100, the user can start or stop a performance operation just by grasping or releasing the grip 120*a*. Compared to the conventional performance operation device that detects finger bend states, the operation apparatus 100 eliminates the need for troublesome works such as attaching or detaching the performance operation device for starting or stopping performance operations. Further, compared to the conventional performance operation device that detects finger bend states, the user can operate the operation apparatus 100 just by holding it. Hence, the operation apparatus 100 is easily fit to hands and is free from being displaced from an attached position. Furthermore, the pressure sensor 132 of the operation apparatus 100 does not directly touch the user's skin. The operation apparatus 100 does not give uncomfortable feeling to users. Accordingly, the operation apparatus 100 leaves no possibility of giving feelings of resistance to a wide age group of users from infants to aged people.

The operation apparatus 100 is provided with the elastic member 150 that applies a restoring force to each of the elastically deforming sections 113T and 113B when the grip strength is released. According to this configuration, the shape of the grip 120*a* can be restored responsively, making it possible to accurately detect continuous grip strength changes in a short period of time.

The pressure-sensitive conductive rubber is known as a sensor capable of detecting pressures acting from a plurality of directions. It is possible to provide a configuration using the pressure-sensitive conductive rubber as the performance operation device that detects grip strength changes. However, the pressure-sensitive conductive rubber is a relatively expensive pressure sensor. A large amount of pressure-sensitive conductive rubber is needed for detecting grip strengths. Accordingly, the use of the pressure-sensitive conductive rubber increases manufacturing costs of the performance operation device.

By contrast, the operation apparatus 100 extracts only strengths along the T and B directions out of grip strengths acting on the grips 120*a* and 120*b* in a plurality of directions. The extracted strengths are applied to the pressure sensor 132. According to this configuration, it is possible to use the pressure sensor 132 to detect unidirectional forces as a sensor to detect grip strengths acting in a plurality of directions. Compared to the pressure-sensitive conductive rubber, the use of a low-price piezoelectric element especially decreases manufacturing costs.

<Second Embodiment>

The following describes the performance system including the operation apparatus according to the second embodiment of the present invention.

In the above-mentioned first embodiment, there has been described the operation apparatus 100 that extracts components of forces along specified directions detectable by the sensor mechanism 130 out of a plurality of forces acting on the grips 120*a* and 120*b* in different directions and applies the extracted forces to the pressure sensor 132. On the other hand, the operation apparatus according to the second embodiment is configured to convert directions of forces acting on the grip 120*a* into directions detectable by the pressure sensor 132 and apply the converted forces to the pressure sensor.

Like the performance system according to the first embodiment, the performance system according to the second embodiment comprises the operation apparatus and the sound reproduction apparatus 200. The configuration of the sound reproduction apparatus 200 is the same as that for the first embodiment, and therefore the description thereof is omitted. Hereinafter, the mutually corresponding parts of the operation apparatus in two embodiments are designated by the same reference numerals.

Figure 10:
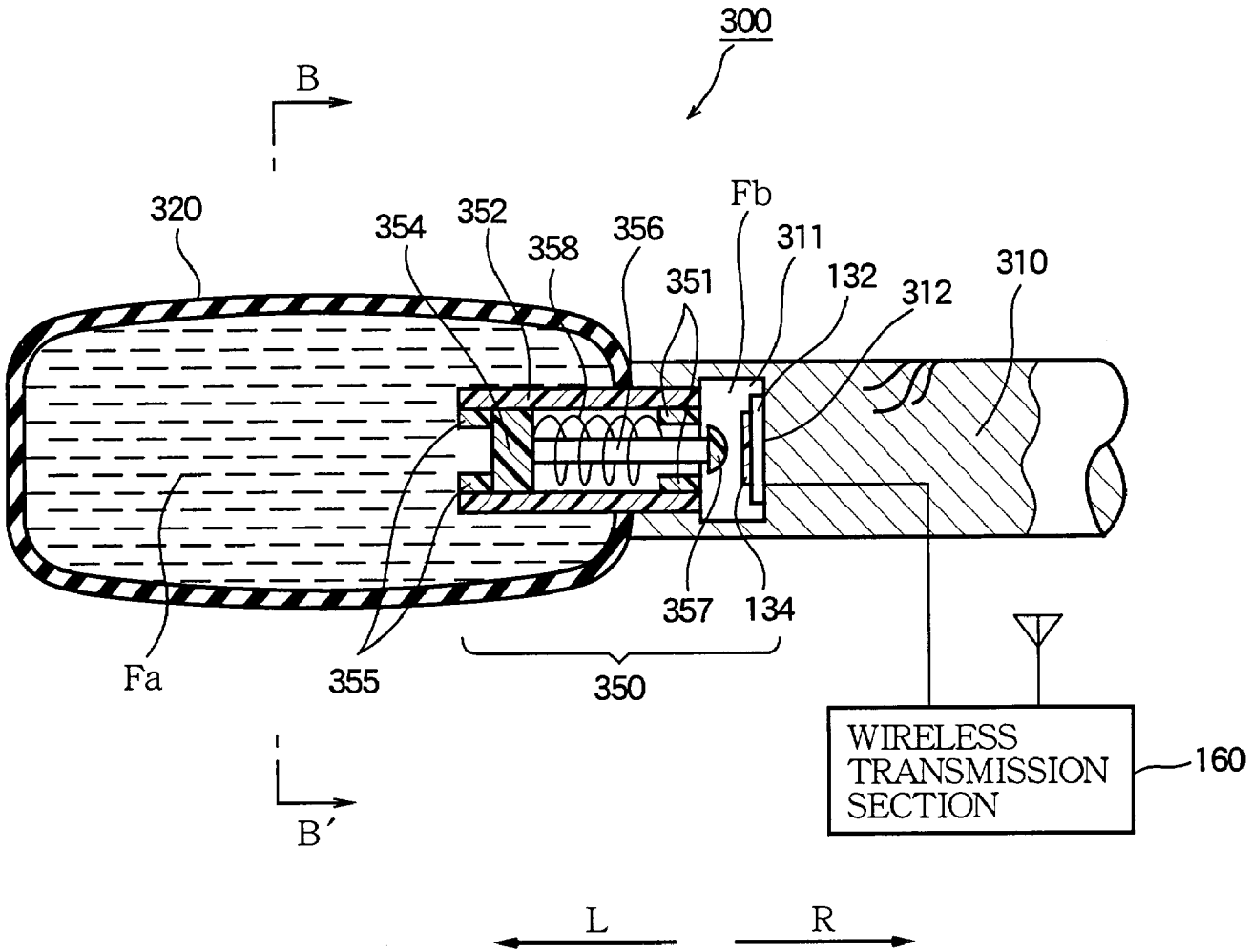
FIG. 10 is a fragmentary sectional view of an operation apparatus included in a performance system according to the second embodiment of the present invention.

FIG. 10 shows a grip of the operation apparatus according to the second embodiment and its peripheral configuration. In FIG. 10, a grip 320 is made of a material capable of bending and deformation and is attached to one end of a shaft 310 so as to be formed as a airtight bag. The grip 320 is preferably made of a material that hardly expands in response to a tensile stress if applied. The inside of the grip 320 is filled with liquid, air, or gelled, semisolid fluid Fa whose viscosity is higher than water.

A hollow section 311 is formed at the end of the shaft 310. The pressure sensor 132 such as a piezoelectric element is attached to a face 312 of the shaft 310 forming the hollow section 311. The pressure sensor 132 has the same detection characteristic (see FIG. 5) as that described for the first embodiment. The pressure sensor 132 is provided so as to be able to detect a force acting in an R direction. The sensor cover 134 is provided to the left of the pressure sensor 132 in FIG. 10 to protect the pressure sensor 132. The hollow section 311 is sealed and is filled with fluid Fb such as air having a low conductivity.

The shaft 310 is provided with a piston mechanism 350 so as to extend from the hollow section 311 to an inside space of the grip 320. The piston mechanism 350 includes a tubular cylinder 352. An elastic piston 354 divides the inside of the cylinder 352 into two spaces: one that links to the inside space of the grip 320 and is filled with fluid Fa; and the other that links to the hollow section 311 and is filled with fluid Fb. The piston 354 slides on the inside surface of the cylinder 352 in accordance with external forces acting in R and L directions in FIG. 10. Each of the R and L directions is approximately parallel to an axis line of the shaft 110 and is opposite to each other.

The left end of the inside face of the cylinder 352 is provided with a stop member 355 that stops movement of the piston 354. The right side of the piston 354 is provided with an elastic member 358 such as a spring so as to touch the piston 354. The right end of the inside face of the cylinder 352 is provided with a stop member 351 that stops the right end of the elastic member 358. When the elastic member 358 elastically deforms, the piston 354 is energized in the L direction by means of a repulsive force of the elastic member 358.

The repulsive force of the elastic member 358 and the pressure of fluid Fb generate a resultant force that is applied to the piston 354 in the L direction. The piston 354 is subject to the pressure of fluid Fa in the R direction. The piston 354 moves in the L or R direction so as to balance these forces.

One end of a piston rod 356 is fixed to the right side of the piston 354. The piston rod 356 is fixed so that its axis line is parallel to the R or L direction. The other end of the piston rod 356 is provided with a pressurization member 357 made of a medium elastic material such as rubber. When the piston 354 moves in the right direction in accordance with the pressure of fluid Fa, the pressurization member 357 presses the pressure sensor 132 via the sensor cover 134.

According to this configuration, the operation apparatus 300 detects as follows whether the grip 320 is hardly grasped, gently grasped, or strongly grasped, and then transmits the detection result as a performance operation signal.

When the grip 320 is hardly grasped, the piston 354 stands still at a position that separates the pressurization member 357 from the sensor cover 134 as shown in FIG. 10. Since no pressure is applied to the pressure sensor 132, the wireless transmission section 160 transmits no performance operation signal.

Figure 11:
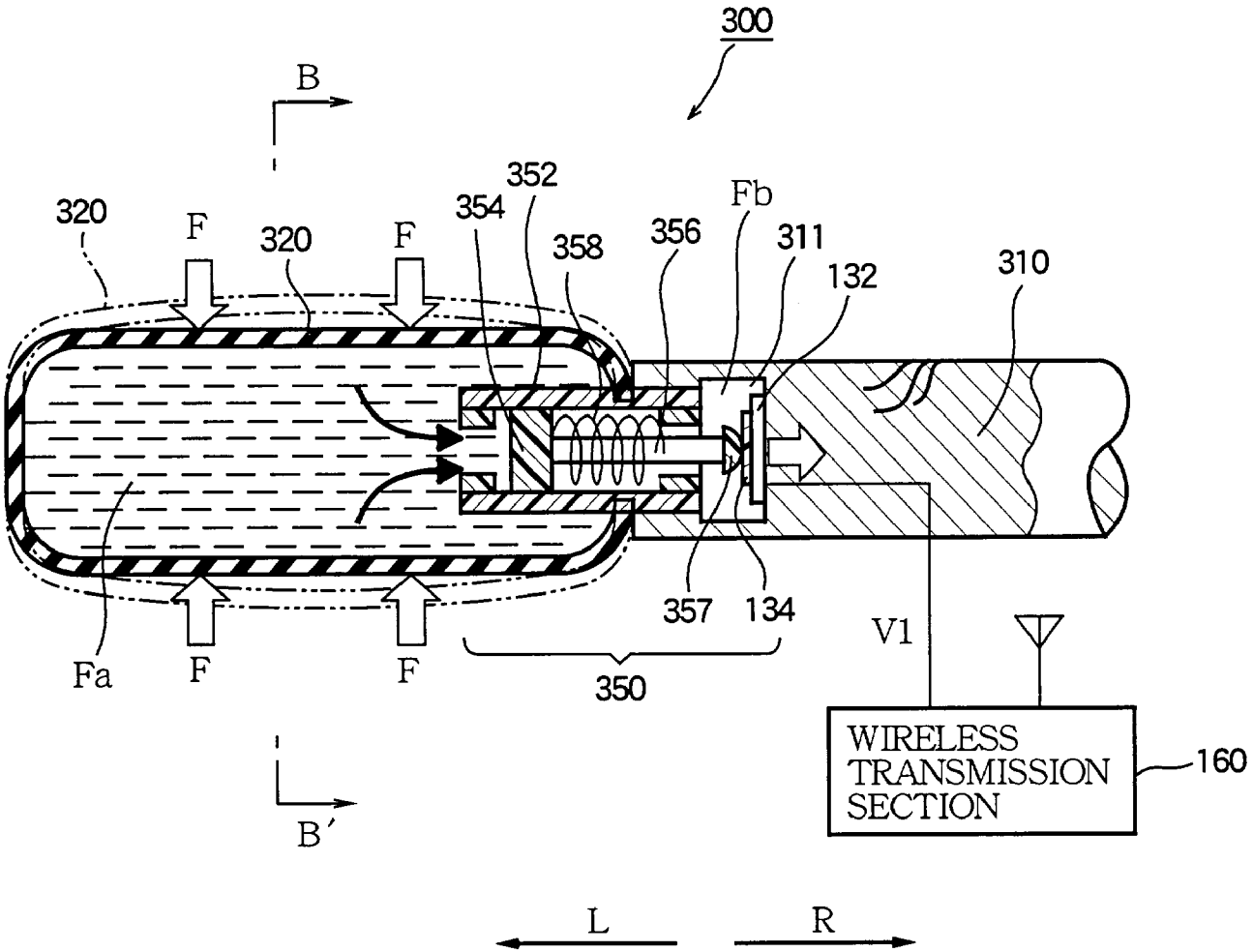
FIG. 11 shows a state of gently grasping a grip included in the operation apparatus according to the second embodiment of the present invention.
Figure 12:
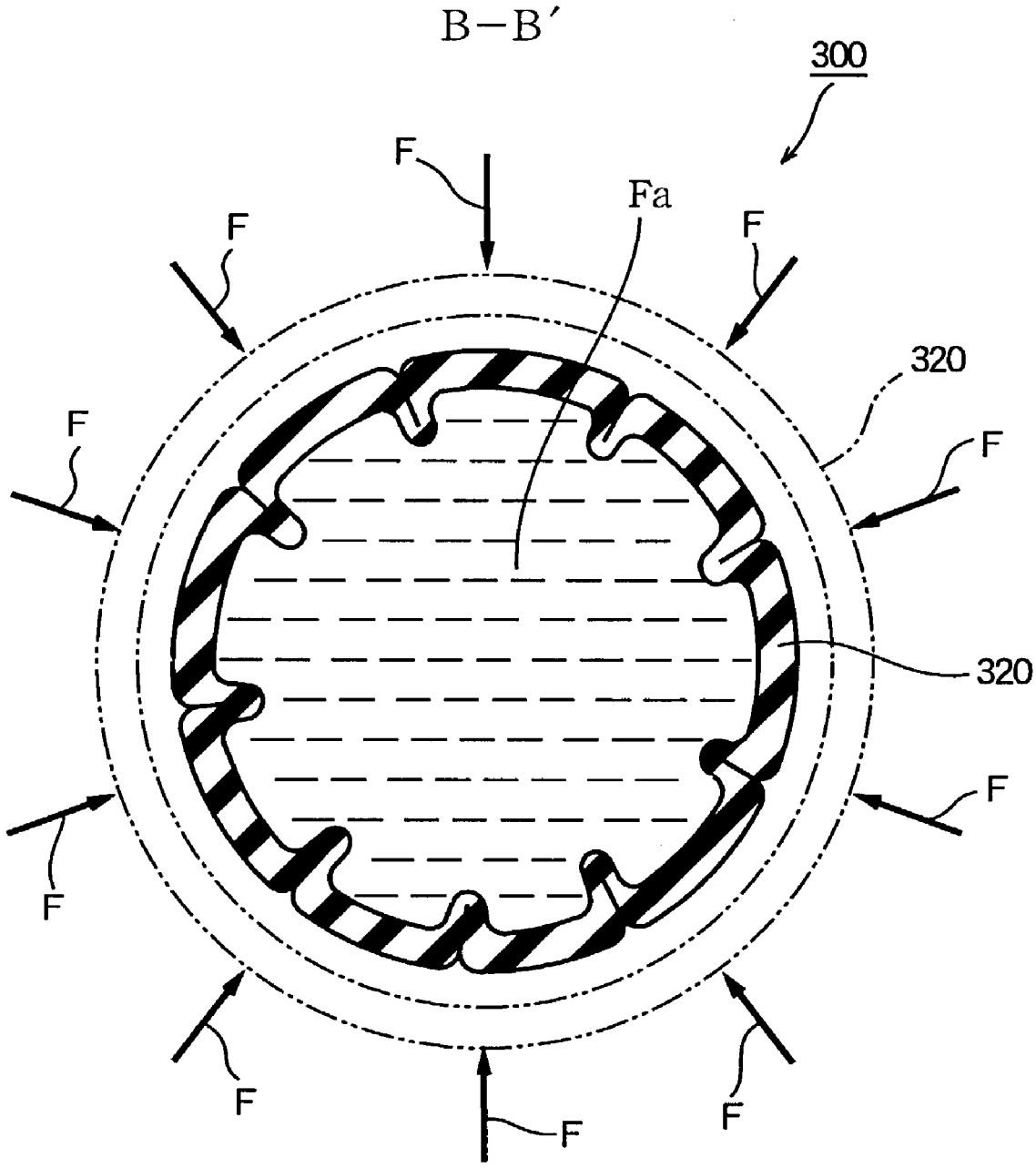
FIG. 12 is a sectional view of the gently grasped grip according to the second embodiment of the present invention.

FIG. 11 shows a state in which the grip 320 is grasped gently. FIG. 12 shows a cross sectional view taken along lines B–B' of the gently grasped grip 320 in FIG. 11. When the grip 320 is grasped gently as shown in FIG. 12, the grip 320 is subject to a plurality of forces F in different directions. When the forces F are applied, the grip 320 is compressed. A cross section area of the compressed grip 320 becomes smaller than that of the grip 320 that is applied with no grip strength and is represented in dash-double-dot lines in FIG. 11. This decreases the volume inside the grip 320 and increases the pressure of fluid Fa.

When the pressure of fluid Fa increases in FIG. 11, the force acting in the R direction increases to move the piston 354 in the R direction. The pressurization member 357 attached to the tip of the piston rod 356 moves in the R direction. The pressurization member 357 presses the pressure sensor 132 with a pressure force of approximately P1 via the sensor cover 134. As a result, the pressure sensor 132 applies voltage value V1 to the wireless transmission section 160. The wireless transmission section 160 transmits voltage value V1 indicating that the grip 320 is grasped gently.

Figure 13:
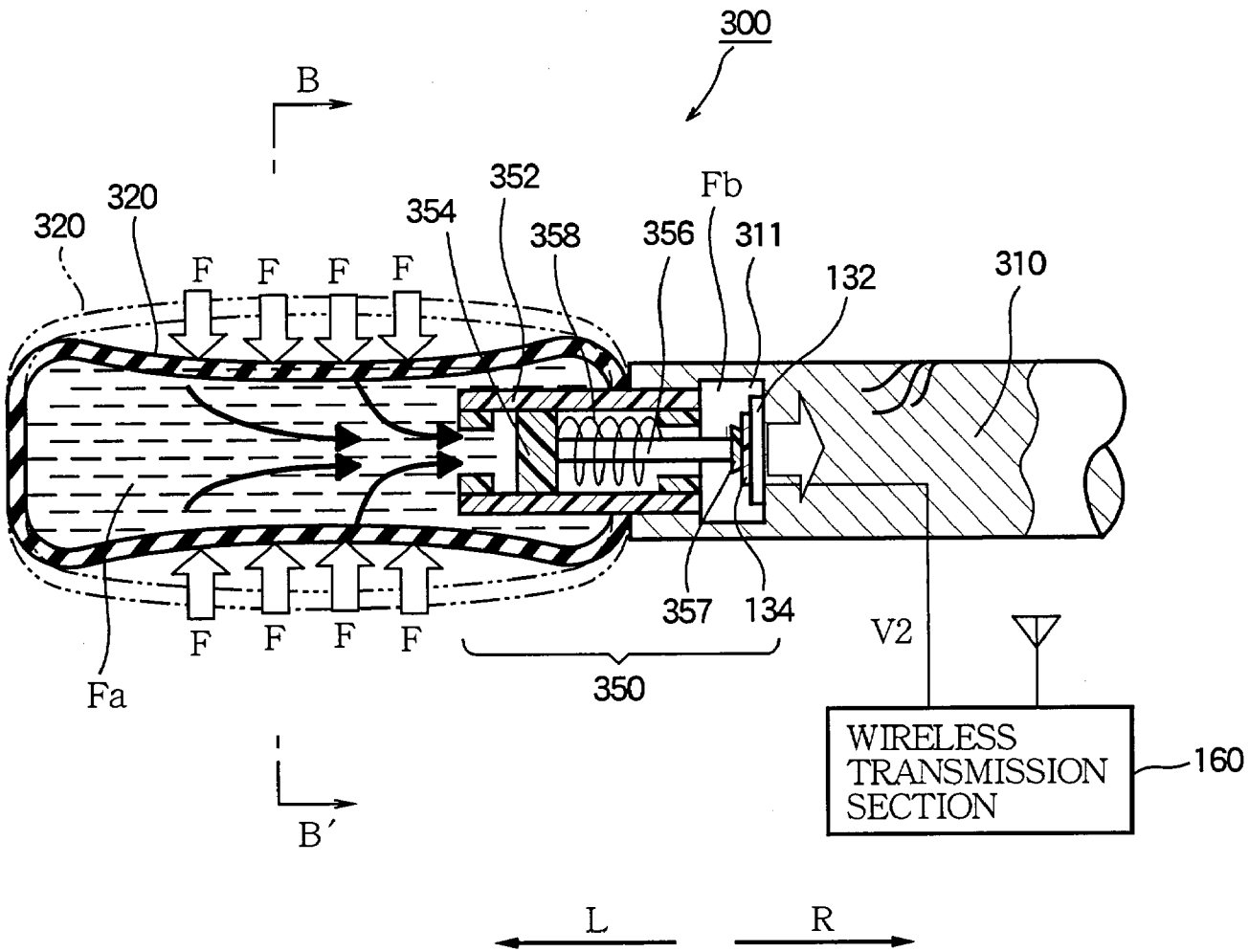
FIG. 13 shows a state of strongly grasping the grip according to the second embodiment of the present invention.

When the grip 320 is grasped strongly as shown in FIG. 13, the grip 320 deforms so that the volume of its inside space becomes much smaller than that of the gently grasped grip 320. This increases the pressure of fluid Fa to move the piston 354 in the R direction further than when the grip 320 is grasped gently. The pressurization member 357 presses the pressure sensor 132 with a pressure force of approximately P2 via the sensor cover 134. As a result, the pressure sensor 132 applies voltage value V2 to the wireless transmission section 160. The wireless transmission section 160 transmits voltage value V2 indicating that the grip 320 is grasped strongly.

Like the performance system according to the first embodiment, the operation apparatus 300 transmits voltage value V. The sound reproduction apparatus 200 receives voltage value V to output a musical sound with the sound volume level corresponding to voltage value V.

As described above, in the handy musical instrument apparatus 300, the grip part 320 comprises a tube filed with a fluid Fa and grasped by the performer to receive the dynamic pressure, and the conversion part 350 comprises a piston 356 movable in the specified axial direction R for converting the dynamic pressure transmitted to the piston 356 through the fluid Fa into the force acting in the specified axial direction R.

In this manner, the operation apparatus 300 converts a plurality of forces F caused by gripping acting on the grip 320 into a force in the specified R direction via fluid Fa and the piston mechanism 350. The converted force presses the pressure sensor 132. When this configuration is used to detect grip strength acting in various directions, it is possible to use the simple and cheep pressure sensor 132 that detects only the unidirectional force. The use of a low-price piezoelectric element for the pressure sensor 132 especially decreases manufacturing costs of the operation apparatus 300.

The operation apparatus 300 converts respective directions of the grip strengths acting on the grip 320 into the R direction, i.e., the detection direction. Accordingly, it is possible to decrease detection losses of the grip strengths and consequently improve the detection accuracy.

Further, the piston mechanism 350 is provided with the elastic member 358. When the grip strength is applied, the elastic member 358 stores an elastic energy. When the grip strength is released, the elastic member 358 releases that energy to move the piston 354 in the L direction. Accordingly, when the grip strength is released, the grip 320 can promptly return to the original shape. Because of this, the grip 320 responsively returns to its shape in accordance with the grip strength. It is possible to accurately detect continuous changes of the grip strengths in a short period of time.

<Modification>

The present invention is not limited to the above-mentioned first and second embodiments but may be subject to various applications, improvements, modifications.

Figure 14:
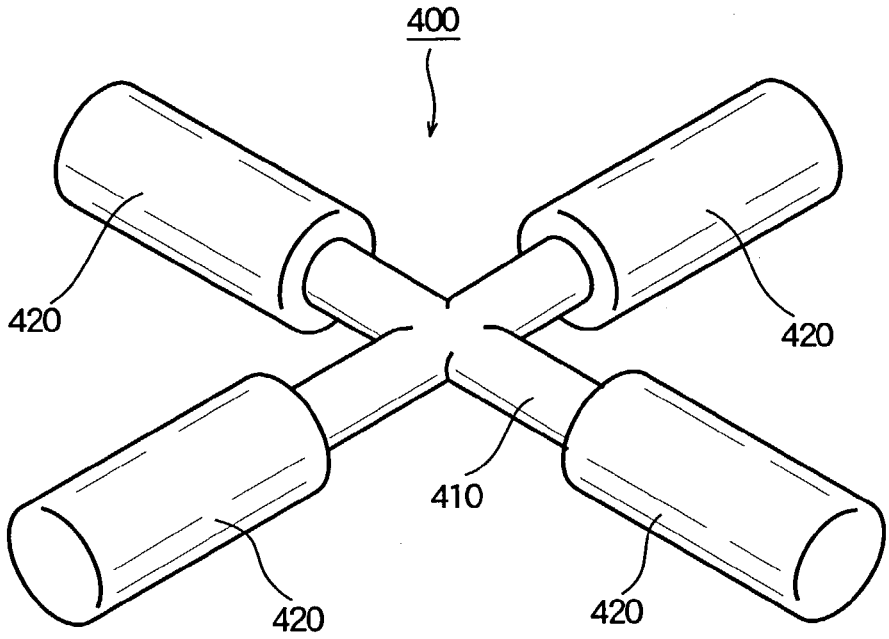
FIG. 14 shows a modification of the operation apparatus according to the first and second embodiments.
Figure 15:
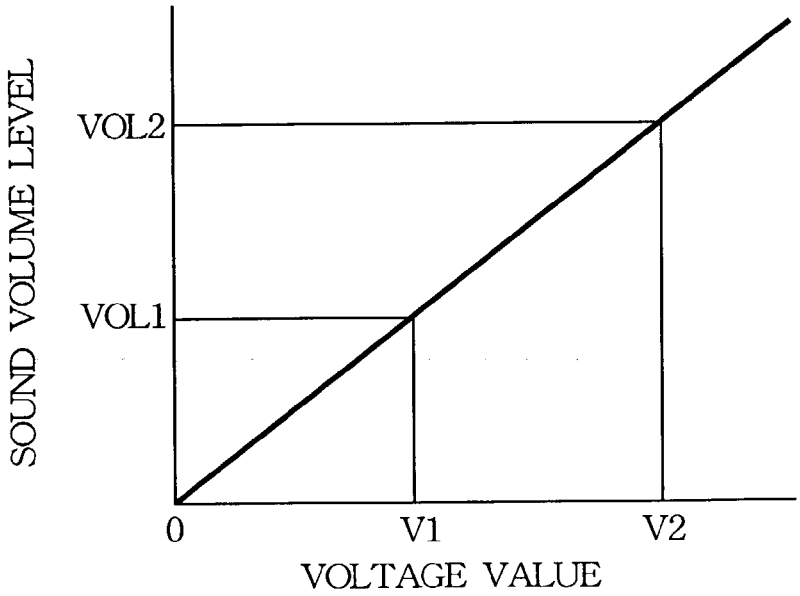
FIG. 15 explains the nature of controlling the sound reproduction apparatus according to the first and second embodiments.

According to the above-mentioned embodiments, the operation apparatus 100 or 300 is provided with two grips 120*a* and 120*b* or 320. The number of grips is not limited to two but may be one or three or more. As shown in FIG. 14, for example, each of a 4-pronged shaft 410 may be provided with a grip 420 as the performance operation device. According to this configuration, each grip 420 can be assigned a different performance operation, diversifying the contents of performance operations. Further, four users can share one operation apparatus 400 for performance.

While the above-mentioned embodiments and their modification have explained performance operations using the examples of instructing volume levels of a musical sound, performance operations that can be instructed by the operation apparatuses 100, 300, and 400 are not limited thereto. For example, it may be preferable to instruct operations concerning song performance using MIDI sound sources, reproduction of audio data corresponding to sampled songs, and the like. More specifically, it may be preferable to start playing (reproducing) a song or provide tempos, sound volumes, intervals, and effect sounds (e.g., reverberant sounds) corresponding to grip strengths acting on the grips 120*a* and 120*b*, 300, and 400. Such configuration makes it possible to instruct more diversified performance operations so that a user can operate the song's reproduction temp with the right hand while operating sound generation of a percussion instrument with the left hand.

As mentioned above, the present invention can provide a performance operation amount detection apparatus capable of easily conducting music performance operations at low costs.

What is claimed is:

1. An apparatus for detecting a performance operation amount rendered by a performer, comprising:

a grip part that is grasped by the performer and shaped to receive a dynamic pressure caused from grasping by the performer for inputting the performance operation amount;

a conversion part that is provided for converting the dynamic pressure applied to the grip part in various directions by the performer into a force acting in a specified direction; and a detection part that is positioned to align a sensitivity thereof with the specified direction for sensing the force generated by the conversion part and outputting a signal indicative of the performance operation amount in response to the sensed force, wherein the grip part has a sleeve shape grasped by the performer to receive the dynamic pressure in radially inward directions of the sleeve shape, and the conversion part has a rod shape, an end portion of which is fitted into the sleeve shape of the grip part, the end portion of the rod shape is cut into a pair of split sections spaced from each other in the specified direction, the split sections being deformable for converting the dynamic pressure applied in the radially inward directions from the grip part into the force acting in the specified direction.

2. The apparatus according to claim 1, wherein the grip part, the conversion part and the detection part are assembled into a set, the apparatus further comprising a body that is shaped so as to mount therein a plurality of the sets.

3. The apparatus according to claim 2, wherein the body is shaped into a rod so that a pair of the sets is mounted in a pair of end portions of the rod.

4. The apparatus according to claim 2, wherein the body is shaped into a cross so that a quartet of the sets is mounted in four end portions of the cross.

5. The apparatus according to claim 1, further comprising a sealing part for sealing the detection part.

6. The apparatus according to claim 1, further comprising a restoring part operative when the grip part is released from grasping of the performer for creating a restoration force effective to restore the conversion part into a rest state thereof.

7. The apparatus according to claim 1, further comprising a wireless transmitting part that transmits the signal in a wireless mode.

8. An apparatus for detecting a performance operation amount rendered by a performer, comprising:

a grip part that is grasped by the performer and shaped to receive a dynamic pressure caused from grasping by the performer for inputting the performance operation amount;

a conversion part that is provided for converting the dynamic pressure applied to the grip part in various directions by the performer into a force acting in a specified direction; and a detection part that is positioned to align a sensitivity thereof with the specified direction for sensing the force generated by the conversion part and outputting a signal indicative of the performance operation amount in response to the sensed force, wherein the grip part comprises a tube filled with a fluid and grasped by the performer to receive the dynamic pressure, and the conversion part comprises a rigid cylinder which annularly envelops a piston to define an expandable volume fluidly coupled to the grip part, the piston being movable within the cylinder in the specified direction for converting the dynamic pressure transmitted to the piston through the fluid into the force acting in the specified direction.

9. A music system comprising an input unit for inputting a signal representative of a performance operation amount rendered by a performer, and an output unit for outputting a music sound in response to the signal fed from the input unit, wherein the input unit comprises:

a grip part that is grasped by the performer and shaped to receive a dynamic pressure caused from grasping by the performer for inputting the performance operation amount;

a conversion part that is provided for converting the dynamic pressure applied to the grip part in various directions by the performer into a force acting in a specified direction; and a detection part that is positioned to align a sensitivity thereof with the specified direction for sensing the force generated by the conversion part and outputting the signal indicative of the performance operation amount in response to the sensed force, wherein the grip part has a sleeve shape grasped by the performer to receive the dynamic pressure in radially inward directions of the sleeve shape, and the conversion part has a rod shape, an end portion of which is fitted into the sleeve shape of the grip part, the end portion of the rod shape is cut into a pair of split sections spaced from each other in the specified direction, the split sections being deformable for converting the dynamic pressure applied in the radially inward directions from the grip part into the force acting in the specified direction.

10. The music system according to claim 9, wherein the input unit includes a wireless transmitter part for transmitting the signal in a wireless mode, and the output unit includes a wireless receiver part for receiving the signal in a wireless mode.

11. The music system according to claim 9, wherein the output unit comprises a generator for generating the music sound composed of a plurality of music parts, and a controller for allotting at least one music part to the input unit while controlling the generator to automatically generate the music sound of the remaining music parts other than the one music part allotted to the input unit such that the performer can manually perform the one music part by operating the input unit along with automatic performance of the remaining music parts by the controller.

12. A music system comprising an input unit for inputting a signal representative of a performance operation amount rendered by a performer, and an output unit for outputting a music sound in response to the signal fed from the input unit, wherein the input unit comprises:

a grip part that is grasped by the performer and shaped to receive a dynamic pressure caused from grasping by the performer for inputting the performance operation amount;

a conversion part that is provided for converting the dynamic pressure applied to the grip part in various directions by the performer into a force acting in a specified direction; and a detection part that is positioned to align a sensitivity thereof with the specified direction for sensing the force generated by the conversion part and outputting a signal indicative of the performance operation amount in response to the sensed force, wherein the grip part comprises a tube filled with a fluid and grasped by the performer to receive the dynamic pressure, and the conversion part comprises a rigid cylinder which annularly envelops a piston to define an expandable volume fluidly coupled to the grip part, the piston being movable within the cylinder in the specified direction for converting the dynamic pressure transmitted to the piston through the fluid into the force acting in the specified direction.

* * * * *